US006752133B2

(12) United States Patent
Arnell

(10) Patent No.: US 6,752,133 B2
(45) Date of Patent: Jun. 22, 2004

(54) INTERNAL COMBUSTION ENGINE WITH EXHAUST GAS RECIRCULATION

(75) Inventor: Jan Arnell, Hisings Karra (SE)

(73) Assignee: Volvo Lastvognar AB, Göteborg (SE)

( * ) Notice: Subject to any disclaimer, the term of this patent is extended or adjusted under 35 U.S.C. 154(b) by 0 days.

(21) Appl. No.: 10/248,146

(22) Filed: Dec. 20, 2002

(65) Prior Publication Data

US 2003/0136387 A1 Jul. 24, 2003

Related U.S. Application Data

(63) Continuation of application No. PCT/SE01/01470, filed on Jun. 27, 2000, now abandoned.

(30) Foreign Application Priority Data

Jun. 28, 2000 (SE) ..... 0002464

(51) Int. Cl.[7] ..... F02M 25/07

(52) U.S. Cl. ..... 123/568.12; 123/568.13; 60/605.2

(58) Field of Search ..... 123/568.12, 568.13, 123/568.18, 568.2; 60/605.2

(56) References Cited

U.S. PATENT DOCUMENTS

| | | | | | |
|---|---|---|---|---|---|
| 3,937,194 | A | * | 2/1976 | Tamaki et al. | 123/568.13 |
| 4,328,781 | A | * | 5/1982 | Morita | 123/568.12 |
| 4,643,157 | A | | 2/1987 | Nishikawa et al. | 123/568 |
| 5,690,081 | A | * | 11/1997 | Kwiatkowski | 123/568.12 |
| 5,762,051 | A | | 6/1998 | Okamoto | 123/568 |
| 5,839,417 | A | | 11/1998 | Kwiatkowski et al. | 123/568 |
| 5,979,421 | A | * | 11/1999 | Yamashita et al. | 123/568.12 |
| RE36,500 | E | * | 1/2000 | Ando et al. | 123/568.13 |
| 6,116,026 | A | * | 9/2000 | Freese, V | 123/568.12 |
| 6,478,017 | B2 | * | 11/2002 | Bianchi | 123/568.12 |
| 6,513,506 | B1 | * | 2/2003 | Ito et al. | 123/568.13 |

FOREIGN PATENT DOCUMENTS

| | | |
|---|---|---|
| EP | 0701048 B1 | 12/1998 |
| FR | 2721349 A1 | 12/1995 |
| JP | 61025962 A | 6/1986 |

* cited by examiner

*Primary Examiner*—Willis R. Wolfe
(74) *Attorney, Agent, or Firm*—Novak Druce LLP

(57) ABSTRACT

Multi-cylinder internal combustion engine having at least one cylinder row (10) with an intake side (10*a*) and an exhaust side (10*b*). The intake side includes an intake manifold (16), and the exhaust side includes at least one exhaust manifold (17) common to a group of cylinders (11–13). A charging unit (18) is connected by its pressure side to an intake air line opening into the intake manifold. The engine also has an arrangement for exhaust gas recirculation from the exhaust side of the engine to its intake side. The arrangement has a recirculation passage (15*b*, 20) which is arranged in the cylinder head(s) of the engine, for the respective group of cylinders and forms a connection between the exhaust manifold (17) and the intake side (10*a*). The passage can be opened and closed by a valve means (19).

15 Claims, 2 Drawing Sheets

INTERNAL COMBUSTION ENGINE WITH EXHAUST GAS RECIRCULATION

CROSS REFERENCE TO RELATED APPLICATIONS

The present application is a continuation of International Application No. PCT/SE01/01470, filed Jun. 27, 2001 now abandoned, published in English pursuant to PCT Article 21 (2) and which claims priority to Swedish Application No. 0002464-6 filed Jun. 28, 2000. Both applications are expressly incorporated herein by reference in their entireties.

BACKGROUND OF INVENTION

1. Technical Field

The present invention relates to a multi-cylinder internal combustion engine having at least one cylinder row with an intake side and an exhaust side. The intake side has an intake manifold, and the exhaust side has at least one exhaust manifold common to a group of cylinders. There is at least one charging unit that is connected at its pressure side to in intake air line opening into the intake manifold. There is also an arrangement for exhaust gas recirculation from the exhaust side of the engine to its intake side.

2. Background

Exhaust gas recirculation, what is known as EGR, is a generally known method in which a part of the total exhaust gas flow of the engine is returned and this part flow is introduced on the inlet side of the engine, where it is mixed with incoming air, to be introduced into the cylinders of the engine. In this way, it is possible to reduce the quantity of nitrogen oxide in the exhaust gases. Although this technique has been in use for a relatively long time, there are a number of problem areas that require solutions.

For example, it can be difficult to produce a sufficient quantity of EGR, in view of engine type and speed/loading. It is also desirable for the transfer of EGR from the exhaust side to the intake side to take place with as little effect as possible on the pressure ratio of the engine (ratio between the pressure on the inlet side and the exhaust side). From the point of view of installation, it is desirable to avoid long and hot pipe runs in the engine, especially on account of inlet and exhaust ducts having outlets on different sides of the cylinder head of the engine. Transfer of EGR can normally take place only when the pressure on the exhaust side of the engine is higher than the pressure on the intake side.

In most cases, one or more EGR valves with a shut-off function are required in order to regulate the quantity of EGR. In order to bring about rapidity of regulation, the EGR valves should be located as close to the exhaust side (the source) as possible, so that the duct volume, between ordinary exhaust valves and a turbo unit connected to the engine, is changed as little as possible by the fitting of the EGR system on the engine. EGR valves are therefore often located close to the exhaust manifold of the engine. However, such positioning is not advantageous from the point of view of service life, as a moving function must be maintained in a very hot environment. In order to cope with the heat, cool ant (or air, for example) is often required, but in some cases lubrication in the form of oil is also necessary, which complicates the construction. If the EGR valve is located on the colder intake side of the engine, it can be designed more simply, but it is then difficult to avoid an increased duct volume upstream of the EGR valve. In diesel-engine-driven trucks with an exhaust-pressure-regulated engine brake, high exhaust pressures are obtained, which the EGR cooler also has to withstand.

SUMMARY OF INVENTION

One object of the present invention is to produce an internal combustion engine with exhaust gas recirculation, and that is adapted to make it possible to design the EGR system more simply and more correctly, with short duct lengths and with a possibility for cooling the EGR valves.

To this end, an internal combustion engine configured according to the invention is characterized in that the arrangement for exhaust gas recirculation from the exhaust side of the engine to its intake side includes a recirculation passage arranged in the cylinder head(s) of the engine. The respective group of cylinders forms a connection between the exhaust manifold and the intake side, and can be opened and closed by a valve means. By virtue of this design of the cylinder head, exhaust gases can be transported from the exhaust side to the intake side via a very short extra passage.

In an advantageous illustrative embodiment of the invention, the valve means can be regulated by control means in such a manner that the passage is opened when the pressure in the associated exhaust manifold is higher than the pressure in the intake manifold, under such circumstances when exhaust gases are to be recirculated.

The valve means are suitably located in the cylinder head(s) of the engine. In this connection, the valve means can be cooled by means of the ordinary cooling system and oil/oil mist and/or coolant of the cylinder head, that is to say no extra pipe connections or the like are required.

According to a further advantageous illustrative embodiment of the invention, the means for exhaust gas recirculation includes a cooler, typically known as an ECR cooler, for cooling the recirculated gas.

The control means can suitably be acted on for moderation of the pressure difference between the exhaust side and the intake side and thus the engine braking effect during engine braking by means of an exhaust gas pressure regulator connected to the engine.

In this connection, the EGR valve can be used as a complement to an exhaust brake arrangement.

BRIEF DESCRIPTION OF DRAWINGS

The invention will now be described in greater detail below, with reference to illustrative embodiments which are shown in the accompanying drawings, in which.

DETAILED DESCRIPTION

Figure 1:
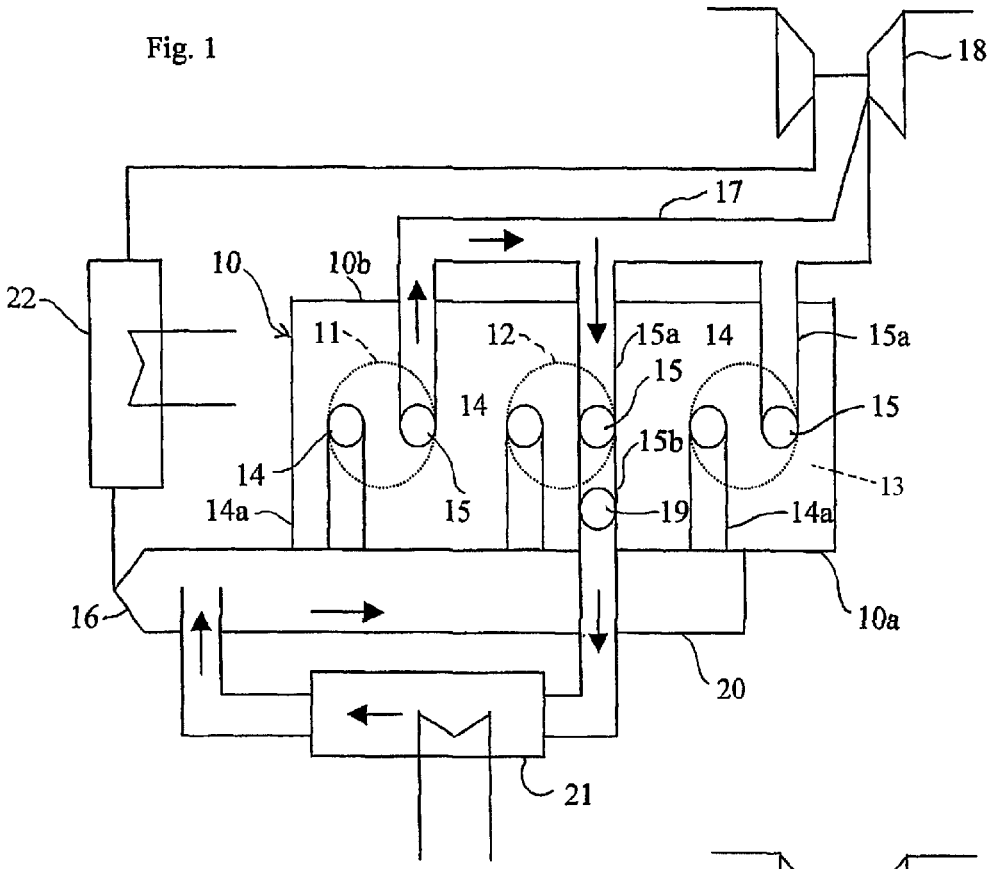
FIG. 1 diagrammatically shows, in a view from above, an internal combustion engine according to the invention in a first embodiment or utilization.
Figure 2:
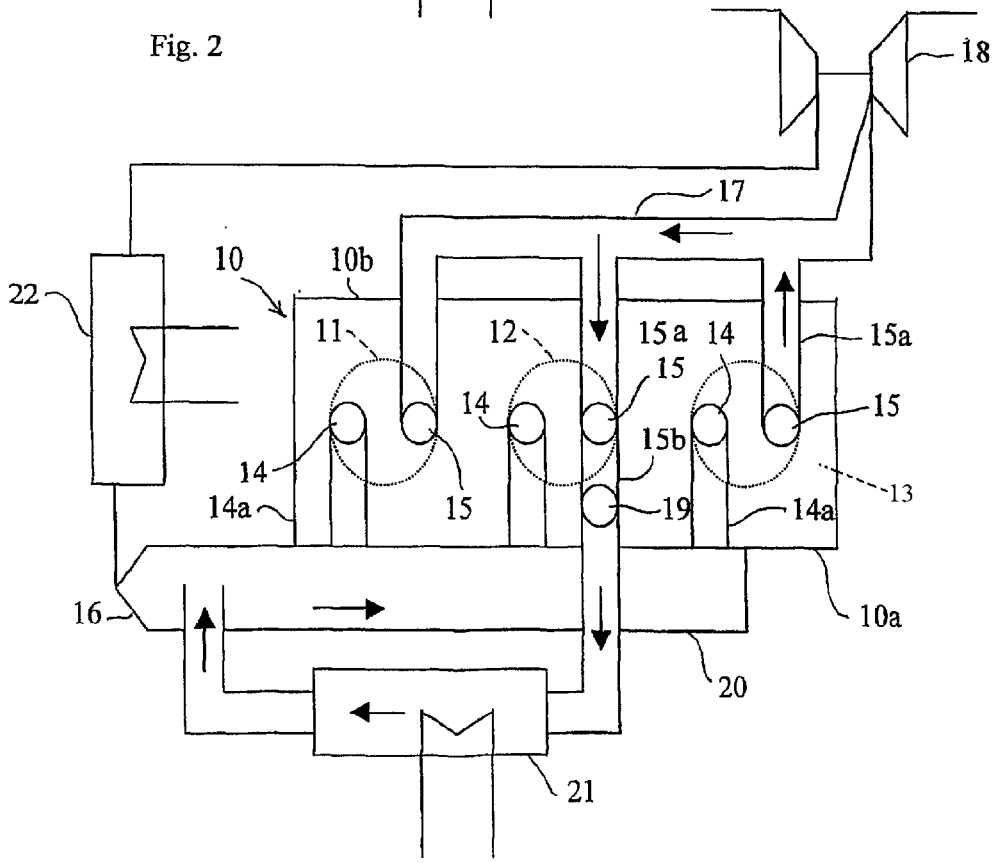
FIG. 2 shows the engine in a corresponding manner in a second embodiment or utilization.
Figure 3:
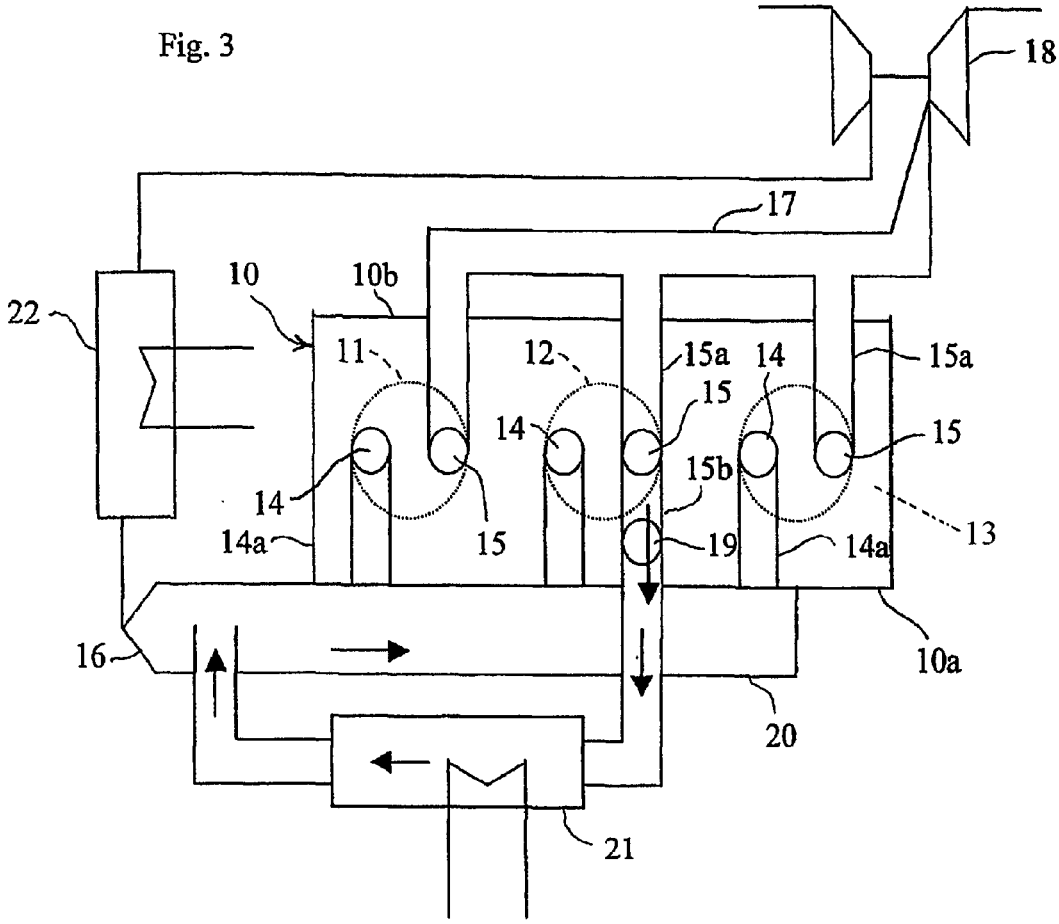
FIG. 3 shows the engine in a corresponding manner in a third embodiment or utilization.

The internal combustion engine shown in FIGS. 1–3 can be, for example, a four-stroke diesel engine that includes a cylinder row 10 with three cylinders 11, 12, 13. The invention can just as well be applied to an engine with more or fewer,cylinders. Each cylinder has an intake valve 14 and an exhaust valve 15. It is of course possible to have a number of intake and exhaust valves per cylinder. The intake valves 14 are connected via intake ducts 14*a* to a common intake manifold 16 located on the intake side 10*a* of the cylinder row. The exhaust valves 15 are connected via exhaust ducts

15*a* to a common exhaust manifold 17 located on the exhaust side of the cylinder row. A turbocharger 18 is located on the exhaust side 10*b* of the cylinder row.

The exhaust duct 15*a* of the central cylinder 12 is provided with a branch portion 15*b* which extends to an EGR valve 19 that is arranged so as to open or close an EGR duct 20 which extends out to the intake side of the cylinder row 10 and on via an EGR cooler 21 mounted on this side of the engine to the intake manifold 16.

Intake air is fed to the intake manifold 16 by means of the turbocharger 18 via a charge air cooler 22.

FIG. 1 shows the EGR flow in a case of application when the exhaust valve 15 of the cylinder 11 is instantaneously open and the EGR valve 19 is opened for returning exhaust gases to the intake side of the engine. In this case, exhaust gases can flow, as the arrows in the figure show, from the cylinder 11 via the exhaust manifold 17 and the exhaust duct of the cylinder 12, past the closed exhaust valve and on past the EGR valve 19 into the EGR duct 20.

FIG. 2 shows the EGR flow in another case of application when the exhaust valve 15 of the cylinder 13 is instantaneously open and the EGR valve 19 is opened for returning exhaust gases to the intake side of the engine. In this case, exhaust gases can flow, as the arrows in the figure show, from the cylinder 13 via the exhaust manifold 17 and the exhaust duct of the cylinder 12, past the closed exhaust valve and on past the EGR valve 19 into the EGR duct 20.

FIG. 3 shows the EGR flow in a case of application when the exhaust valve 15 of the cylinder 12 is instantaneously open and the EGR valve 19 is opened for returning exhaust gases to the intake side of the engine. In this case, exhaust gases can flow, as the arrows in the figure show, directly from the cylinder 12 and its exhaust duct past the EGR valve 19 and into the EGR duct 20.

Figure 4:
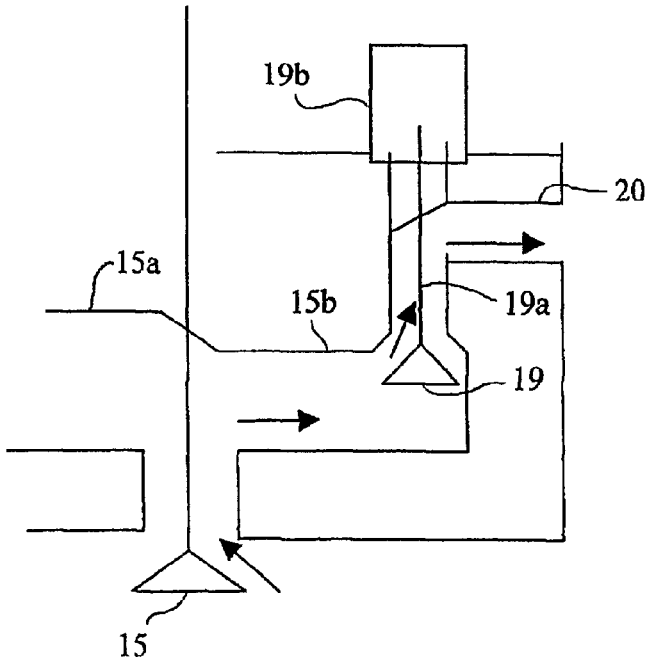
FIG. 4 diagrammatically shows a side view of an EGR duct that forms a part of the invention.

FIG. 4 shows how the EGR flow is integrated in the cylinder head, close to the cylinder 12. It can be seen from this figure that the branch portion 15*b* essentially forms an extension, horizontal in the figure, of the exhaust duct 15. The EGR valve 19 is mounted with its valve stem 19*a* in an essentially vertical angle portion of the EGR duct 20 which otherwise extends in the main horizontally out to the intake side of the cylinder head. This design results in small changes in terms of machining in the cast cylinder head which do not lead to any new machining planes, which favors an inexpensive production solution.

An operating device 19*b* for operating the EGR valve is mounted in the cylinder head so that it is surrounded by the cylinder head cover of the engine. In this connection, any noise from the working of the EGR valve will be damped by the cylinder head cover. Moreover, the EGR valve can be cooled effectively by the ordinary cooling system and oil/oil mist of the engine. If the EGR valve is electronically controlled, the installation described above results in the electronic connection being wall protected inside the cylinder head cover of the engine.

In a diesel engine which is intended for a truck and is provided with an activatable engine brake, the EGR installation described above means a minimal extra volume when the EGR valve is closed, the result of which is that the engine braking effect is not negatively affected. It is also possible to use the EGR valve for moderation of the engine braking effect.

The solution described above can easily be doubled for use on a six-cylinder engine, the exhaust ducts at cylinders 11 and V being provided with EGR valves according to the solution described above.

The invention is not to be considered as being limited to the illustrative embodiments described above, but a number of further variants and modifications are possible within the scope of the patent claims below. The invention can also be applied to engines with cylinders in a V-configuration.

What is claimed is:

1. A method for providing exhaust gas recirculation in a multi-cylinder internal combustion engine, said method comprising:

providing a plurality of cylinders in a multi-cylinder internal combustion engine with cylinder heads configured so that each of said cylinders is connectable in fluid communication with a common exhaust manifold via an exhaust port formed in a respective head of the cylinder;

providing an exhaust gas recirculation passage through an adapted one of said cylinder heads of said plurality of cylinders for recirculating exhaust gases from said exhaust manifold to an air intake side of said engine, said exhaust gas recirculation passage being at least partially constituted by said exhaust port formed in that adapted one of said cylinder heads; and operating said multi-cylinder internal combustion engine so that recirculation exhaust gas from each of said plurality of cylinders passes through the adapted one of said cylinder heads toward the air intake side of said engine.

2. The method as recited in claim 1, further comprising:

causing recirculating exhaust gas to flow in a substantially opposite direction through said exhaust port of the adapted one of said cylinder heads as compared to when exhaust gas is being exhausted to said exhaust manifold from the cylinder associated with the adapted one of said cylinder heads.

3. The method as recited in claim 1, wherein said exhaust gas recirculation passage through said adapted one of said cylinder heads is arranged so that recirculating exhaust gases traveling from said exhaust manifold to the air intake side of said engine pass through said exhaust gas recirculation passage in fluid communication with an exhaust valve of the cylinder through the head of which said exhaust gas recirculation passage is formed.

4. The method as recited in claim 3, further comprising:

providing an exhaust gas recirculation valve in said exhaust gas recirculation passage, said exhaust gas recirculation valve being located downstream of said exhaust valve of the cylinder through the head of which said exhaust gas recirculation passage is formed during exhaust gas recirculation.

5. The method as recited in claim 1, wherein said cylinder heads are each established as a respective portion of a unitarily formed cover to said plurality of cylinders.

6. The method as recited in claim 5, wherein said exhaust gas recirculation valve is opened when pressure in said exhaust manifold is higher than pressure on the intake side of said engine for a time period that gives a desired exhaust gas recirculation flow.

7. The method as recited in claim 5, further comprising:

regulating said exhaust gas recirculation valve by control means so that said exhaust gas recirculation passage is opened when pressure in said exhaust manifold is higher than pressure in an intake manifold to said engine and when exhaust gases are to be recirculated.

8. The method as recited in claim 7, wherein said control means moderates a pressure difference between an exhaust side and the intake side of said engine during engine braking by means of an exhaust gas pressure regulator connected to said engine.

9. An arrangement for providing exhaust gas recirculation in a multi-cylinder internal combustion engine, said arrangement comprising:

an internal combustion engine having a plurality of cylinders provided with cylinder heads configured so that each of said cylinders is connectable in fluid communication with a common exhaust manifold via an exhaust port formed in a respective head of the cylinder; and an exhaust gas recirculation passage extending through an adapted one of said cylinder heads of said plurality of cylinders for recirculating exhaust gases from said exhaust manifold to an air intake side of said engine, said exhaust gas recirculation passage being at least partially constituted by said exhaust port of that adapted one of said cylinder heads and said multi-cylinder internal combustion engine being configured so that recirculation exhaust gas from each of said plurality of cylinders passes through the adapted one of said cylinder heads toward the air intake side of said engine.

10. The arrangement as recited in claim 9, further comprising:

valve means for causing recirculating exhaust gas to flow in a substantially opposite direction through said exhaust port of the adapted one of said cylinder heads as compared to when exhaust gas is being exhausted to said exhaust manifold from said cylinder through the head of which said exhaust gas recirculation passage is formed.

11. The arrangement as recited in claim 9, wherein said cylinder heads are each established as a respective portion of a unitarily formed cover.

12. The arrangement as recited in claim 9, wherein the internal combustion engine is a charge-air-cooled turbo-engine.

13. The arrangement as recited in claim 9, further comprising:

arranging said exhaust gas recirculation passage through said adapted one of said cylinder heads so that recirculating exhaust gases traveling from said exhaust manifold to the air intake side of said engine pass through said exhaust gas recirculation passage in fluid communication with an exhaust valve of the cylinder through the head of which said exhaust gas recirculation passage is formed.

14. The arrangement as recited in claim 13, further comprising:

an exhaust gas recirculation valve provided in said exhaust gas recirculation passage, said exhaust gas recirculation valve being located downstream of said exhaust valve of the cylinder through the head of which said exhaust gas recirculation passage is formed during exhaust gas recirculation.

15. The arrangement as recited in claim 13, further comprising:

a cooler arranged for cooling recirculated exhaust gas.

* * * * *

UNITED STATES PATENT AND TRADEMARK OFFICE

CERTIFICATE OF CORRECTION

PATENT NO. : 6,752,133 B2
DATED : June 22, 2004
INVENTOR(S) : Jan Arnell

It is certified that error appears in the above-identified patent and that said Letters Patent is hereby corrected as shown below:

Title page,
Item [73], Assignee, -- (73) Asignee: Volvo Lastvagnar AB, Göteborg (SE) --

Signed and Sealed this

Twelfth Day of October, 2004

JON W. DUDAS
*Director of the United States Patent and Trademark Office*